United States Patent [19]

Brandt

[11] 4,186,783

[45] Feb. 5, 1980

[54] CHEMICAL INJECTOR

[76] Inventor: Michael W. Brandt, P.O. Box 1092, Stillwater, Okla. 74074

[21] Appl. No.: 652,372

[22] Filed: Jan. 26, 1976

Related U.S. Application Data

[63] Continuation of Ser. No. 462,364, Apr. 19, 1974, abandoned.

[51] Int. Cl.[2] ..... B65B 3/32

[52] U.S. Cl. ..... 141/18; 141/347; 222/402

[58] Field of Search ..... 141/2-5, 141/9, 18, 19, 20, 100, 329, 330, 346-355, 360, 362, 363, 375, 383, 384; 222/402, 401, 386, 400.8

[56] References Cited

U.S. PATENT DOCUMENTS

| | | | |
|---|---|---|---|
| 984,187 | 2/1911 | Bond | 222/402 |
| 2,168,396 | 8/1939 | Davis | 141/346 X |
| 2,661,126 | 12/1953 | Spencer | 222/386 |
| 2,989,091 | 7/1961 | Lowenthal | 141/18 X |
| 3,156,385 | 11/1964 | Yetter | 141/346 X |
| 3,291,348 | 12/1966 | Chibret et al. | 141/3 X |
| 3,709,409 | 1/1973 | Collins | 222/402 |
| 3,968,820 | 7/1976 | Kalb et al. | 141/330 |

*Primary Examiner*—Frederick R. Schmidt

*Attorney, Agent, or Firm*—Gerald G. Crutsinger; Harry C. Post, III; John F. Booth

[57] ABSTRACT

A pressurizable container adapted to spray liquids such as chemical pesticides onto a surface in combination with apparatus to inject a pre-measured quantity of chemical into the container. The injection apparatus comprises a tubular body detachably connected to the container, a cartridge containing a measured quantity of liquid chemical positioned in the tubular body, and a plunger movable through the tubular body to force the liquid chemical from the cartridge. The cartridge contains a piston at one end to be acted on by the plunger arranged to force the premeasured liquid through a valve at the other end into the container.

5 Claims, 8 Drawing Figures

CHEMICAL INJECTOR

This is a continuation of application Ser. No. 462,364, filed Apr. 19, 1974, now abandoned.

BACKGROUND

Numerous hazards are encountered in handling chemical pesticides and fertilizers due to the poisonous nature of these chemicals.

Hazards arise when the young, the uneducated, the illiterate, and inexperienced users attempt to introduce chemicals into a sprayer. Dangers arise from the improper handling of such chemicals both to the user from improper body contact with the chemical and to the crops from improper doses of the chemical.

Plants are harmed when an excessive quantity of pesticide or chemical is applied to them. This is often caused by an inexperienced or illiterate person using the chemical in such a way that plants react adversely to excessive amounts of chemical or pesticide. Farmers often issue pesticides to farm workers to apply to crops but the farm worker may be unable to determine the proper quantity or method of the application due to lack of knowledge of the numerous chemicals on the market today.

Likewise nurseries often issue bulk quantities of pesticides and chemicals to inexperienced home gardeners who may not have the proper respect for the dangers of such highly dangerous chemicals and pesticides. Further, one who is experienced in the use of pesticides and chemicals often has a tendency to become careless and mishandle these valuable but dangerous chemicals.

The United States Department of Agriculture has released many bulletins, which outline safety rules for pesticide application, admonishing one to read and follow directions on the pesticide container. These rules include mixing the pesticide solutions in a well ventilated area to avoid inhaling the sprays or dusts; the avoidance of mixing flammable solutions around an open flame; avoidance of over application of chemicals onto areas frequented by pets and wildlife; avoidance of harmful over application of chemicals to flowers and ornamental shrubs and other valuable plants; avoidance of chemical contact with skin and clothing including directions to wash away any residue, immediately following handling, with soap and water and to change clothing; and storage of pesticides and chemicals in well labeled containers out of the reach of children and pets. These safety rules have been formulated by the U.S. Agriculture Department to safeguard the public since many people have been poisened due to the improper use of chemicals.

Often problems develop in the misappropriation of poisons in a bulk state from an agency which issues pesticides and chemicals to employees in a bulk state. Heretofore, the employee has known that there was no way to trace small quantities of these chemicals issued and consequently appropriation of chemical for his own use has often occured.

This invention is intended to alleviate the above recited problems.

SUMMARY

I have devised a chemical injector to inject a premeasured quantity of liquid from a pre-packaged cartridge into the inside of a mixing container or tank of a compression sprayer employed for applying sprayable solutions of pesticides and other agricultural, commercial or industrial chemicals generally diluted in water.

The injector is a disengagable unit or attachment for a container or tank constructed for sale as a separate unit and removable for recharging with a measured quantity of liquid. Such unit has a disengagable plunger which fits into a barrel into which a cartridge containing a pre-measured quantity of chemical pesticide is disposed. The plunger is urged downwardly to force the chemical through a spring-urged valve into the mixing container or tank of the compression sprayer, which has been partially filled with water, to form a sprayable solution.

A primary object of the invention is to provide a pre-packaged and pre-measured quantity of pesticide or chemical for injection into sprayers to prevent errors in the amount of chemical used for mixing solutions of pesticide.

A further object of the invention is to provide a premeasured quantity of liquid for mixing to form a solution such that workmen who are unable to read will be able to use the chemical safely and accurately.

A further object of the invention is to provide a method of injecting a chemical into a mixing container safely without bodily contact with the chemical.

A further object of the invention is to provide a method of injecting chemicals into a mixing container while minimizing waste or spillage of the chemical.

A further object of the invention is to provide a prepackaged amount of chemicals such that strict supervision of the distribution of chemicals is feasible.

A still further object of the invention is to provide apparatus to mix a pre-measured quantity of chemical with water in a sprayer on the job site while minimizing measuring and handling of the chemical.

A still further object of the invention is to provide a safety container for chemicals which cannot be accidentally opened by children or pets.

A still further object of the invention is to provide a container for chemicals which reduces the possibility of releasing dangerous vapors of the chemicals which could harm the user.

These and other objects are effected by the invention as will be apparent by referring to the following description in conjunction with the accompanying drawings.

DESCRIPTION OF DRAWINGS

Drawings of three embodiments of the invention are annexed hereto, so that the invention may be better and more fully understood, in which.

Numeral references are employed to designate like parts throughout the various figures of the drawing.

DESCRIPTION OF A PREFERRED EMBODIMENT

Figure 1:
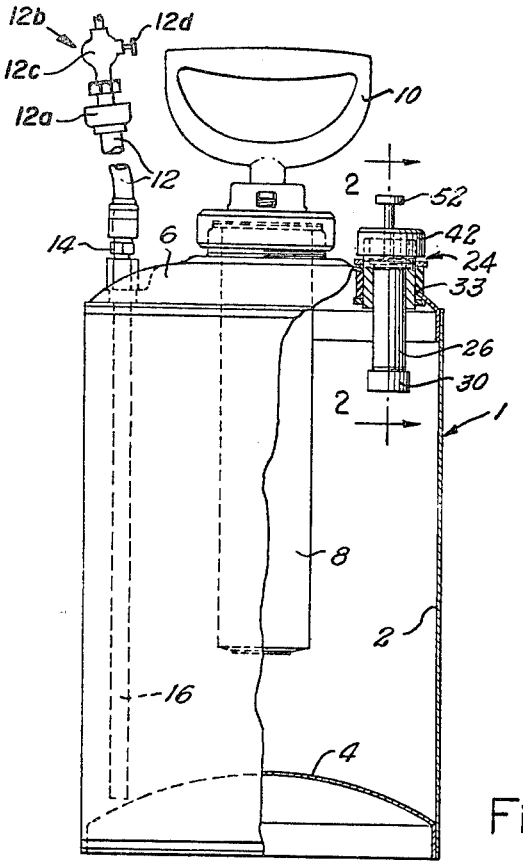
FIG. 1 is an elevational view of a pressurized pesticide spray container having the chemical injector apparatus connected thereto, parts being broken away to more clearly illustrate details of construction.

Referring to FIG. 1 of the drawing, the numeral 1 generally designates a cylindrical shaped container having a side wall 2, a bottom 4 welded or otherwise secured to the lower end of the side wall, and a top wall 6. Top wall 6 has an air pump 8 secured thereto communicating with the inside of the container.

The air pump comprises a stuffing box having suitable sealing apparatus therein through which a plunger having a handle 10 on one end and a piston (not shown) on the other end is slidably disposed for pressurizing the container 1 by pumping air thereinto through a check valve. Conventional locking apparatus is employed for detachably securing handle 10 in the position illustrated in FIG. 1 after air has been pumped into the container.

When it is desired to increase pressure inside the container 1 handle 10 is rotated, for example 35 degrees permitting movement thereof relative to container 1 for pumping air into the container and increasing pressure therein.

A hose 12 is secured by a suitable coupling 14 to a pressure tube 16 having a lower end positioned adjacent to bottom 4 of the container 1.

The other end of hose 12 is connected by a threaded connector 12*a* to a conventional spray gun 12*b* having a suitable valve 12*c* actuated by a trigger 12*d* disposed therein for controlling fluid which is dispensed from the nozzle.

Pressurized container 1 and the spray gun are of conventional design and are described herein only to illustrate a suitable form of apparatus to which the injector apparatus is connectable.

Figure 2:
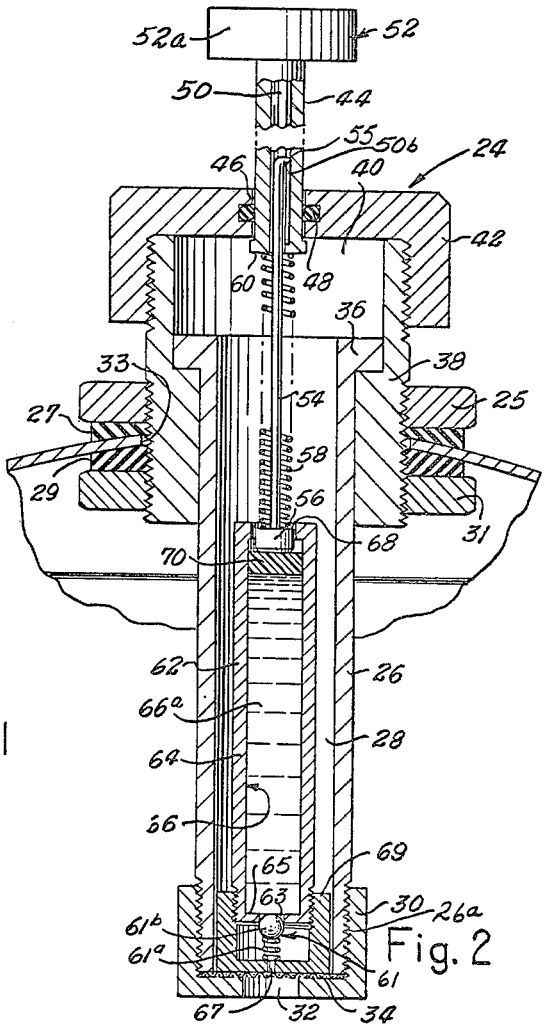
FIG. 2 is a cross-sectional view taken along line 2—2 of FIG. 1 the plunger of the injector apparatus being illustrated in an extended position.
Figure 4:
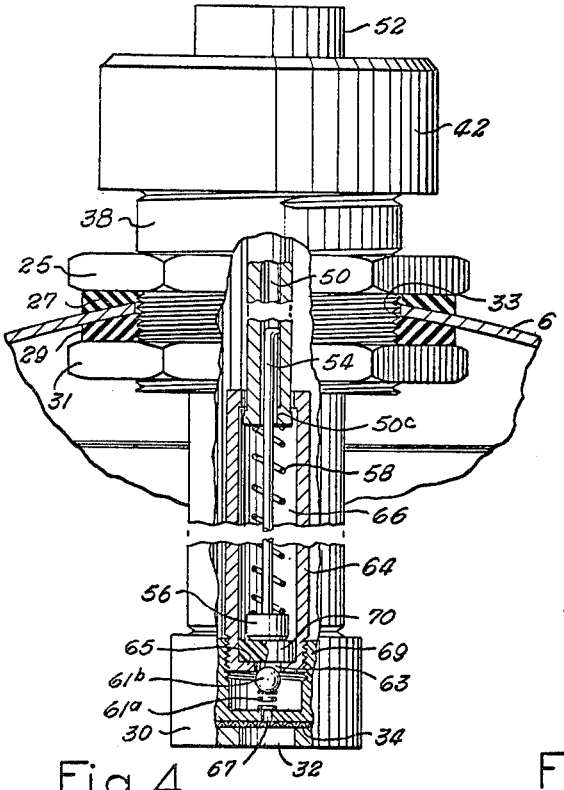
FIG. 4 is a partially sectionalized elevational view similar to FIGS. 2 and 3, the piston being illustrated in a retracted position after contents of the cartridge have been forced into the container.

Referring to FIGS. 1 and 2, the numeral 24 generally designates the injector apparatus.

The injector apparatus 24 comprises a tubular body 26 having a bore 28 extending longitudinally therethrough. The lower end of tubular body 26 has external threads 26*a* formed thereon engagable with internally threaded cap 30.

Cap 30 has an aperture 32 centrally located in the bottom thereof across which a strainer 34 is positioned.

A shoulder 36 is formed on the upper end of tubular body 26 and extends into a counter bore 40 formed in hollow adapter 38. Tubular body 26 extends through the adapter 38 and is suspended from shoulder 36. As will be hereinafter more fully explained, the adapter 38 extends through an aperture 33 formed in the top wall 6 of container 1.

The upper portion of adapter 38 is threadedly engaged with a cap 42 through which plunger 44 slidably extends.

Cap 42 has a hole 46 extending centrally therethrough, in which plunger 44 is slidably disposed. Sealing means such as O-ring seal 48 is in sealing engagement with the outer surface of plunger 44.

Plunger 44 is comprised of a tubular member having a bore 50 extending longitudinally therethrough and having a plunger head 52*a* on the upper end thereof. A groove 50*b* extends longitudinally of bore 50 and has an abutment 50*c* at the lower end thereof.

A piston rod 54 is slidably disposed in bore 50 and projection 55 is movable along groove 50*b*. The piston rod 54 has a piston 56 connected to the lower end and has a laterally extending projection 55 secured to the upper end. A spring 58 is positioned about rod 54, one end of the spring being engageable with piston 56 and the other end with shoulder 60 on the lower end of plunger 44.

A cartridge 62, containing a pre-measured quantity of liquid is positioned in the bore 28 of tubular body 26. The cartridge 62 comprises a tubular body 64 having a bore 66 extending longitudinally therethrough forming a chamber having a premeasured quantity of liquid therein. The upper end of the cartridge 62 has an aperture 68 extending through the wall thereof. A resilient sealing piston 70 is movably disposed in bore 66 in sealing engagement with inner surface of walls of the tubular body to prevent leakage of the liquid from the cartridge 62 through aperture 68.

The sealing piston 70 in cartridge 62, as illustrated in FIG. 2, wipes the interior walls of cartridge 62 along the length of bore 66, thereby wiping all traces of chemical from said walls such that piston head 56 and spring 58 do not engage poisons. The plunger apparatus 52 is, therefore, not contaminated to permit handling after injection of the poison into the container 1.

The lower end of the cartridge 62 is threadedly engaged by cap 69. Cap 69 has an orifice 67 centrally located therethrough. Cartridge 62 has a bottom 65 with an aperture 63 communicating with the interior of cap 69. A spring urged valve 61 is disposed between bottom 65 of cartridge 62 and cap 69 to close the aperture 63. Valve 61 comprises a valve ball 61*b* resiliently urged toward orifice 63 by a spring 61*a*.

The injector apparatus 24 is detachably secured to container 1 by nuts 25 and 31 threadedly secured to the lower end of adapter 38 which extends through aperture 33 formed in the top wall 6 of container 1. Sealing gasket 27, on the upper surface of top 6 of the spraying apparatus 1, and sealing gasket 29 are urged into sealing engagement with upper and lower surfaces of the top 6 of the container upon tightening nuts 25 and 31 to securely fasten and seal the injector apparatus 24 to the spraying apparatus 1.

Having described the first form of my invention, the operation is as follows:

The injector apparatus 24 is positioned through an aperture 33 in the top of a spraying apparatus 1 and held in position by nuts 25 and 31.

The cap 42 is disengaged from the adapter 38 and a cartridge 62, which has been precharged and sealed with liquid chemical 66*a*, is placed into the bore 28 of the tubular body 26. The cap 42 with plunger 44 is then replaced.

To inject the pre-measured quantity of liquid into the container 1, the operator presses on plunger head 52*a* thereby moving the plunger 44 from the position illustrated in FIG. 1 to the position illustrated in FIG. 2. Spring 58 resiliently urges piston head 56 through aperture 68 in cartridge 62 into engagement with sealing piston 70 in the cartridge 62. The force applied to sealing piston 70 pressing on the liquid 66*a* contained in a cartridge 62 exerts pressure to open valve 61 permitting flow of liquid through the cap 69, through orifice 67, and through aperture 32 into the container 1.

Figure 3:
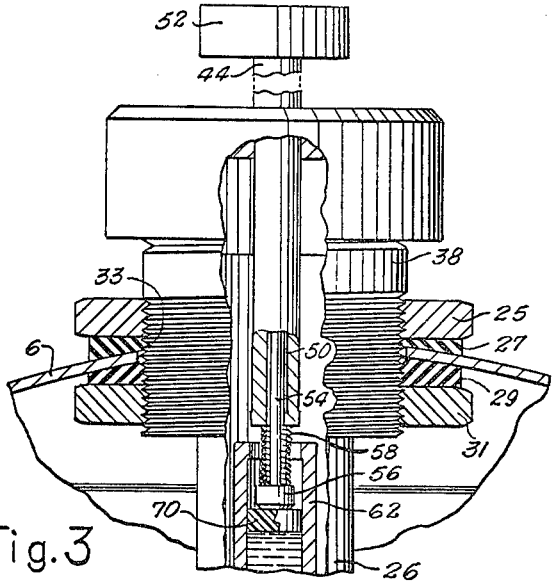
FIG. 3 is a partially sectionalized elevational view similar to FIG. 2, the plunger of the injector apparatus being illustrated in a retracted position to force contents of the cartridge into the container.

As piston 56 is urged by spring 58 to the position illustrated in FIG. 3, all the liquid contained in cartridge 62 is dispensed into the container 1. It should be appreciated that spring 58 prevents application of excessive force on sealing piston 70 which might result in leakage of liquid between adjacent surfaces of sealing piston 70 and the inner wall of cartridge 62.

It should be readily apparent that because of the threadedly engaged cap 69 of the cartridge 62 the cartridge is refillable.

This embodiment of the injector apparatus 24 allows a prepackaged, premetered quantity of chemical to be injected into the sprayer apparatus 1 without human hands, eyes, or mouth coming into contact with chemicals contained in cartridge 62 and minimizes the possibility that the operator might inhale toxic vapor.

SECOND EMBODIMENT

Figure 5:
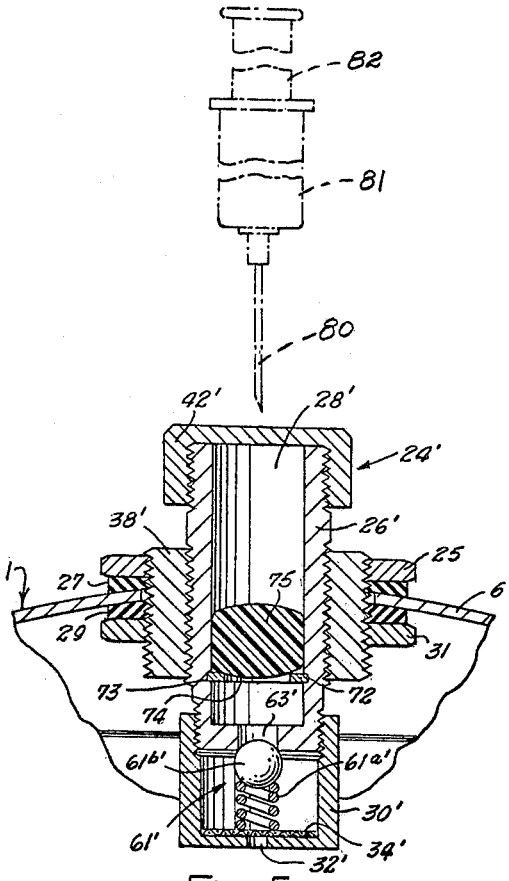
FIG. 5 is a cross-sectional view of a second embodiment of the injector apparatus.
Figure 6:
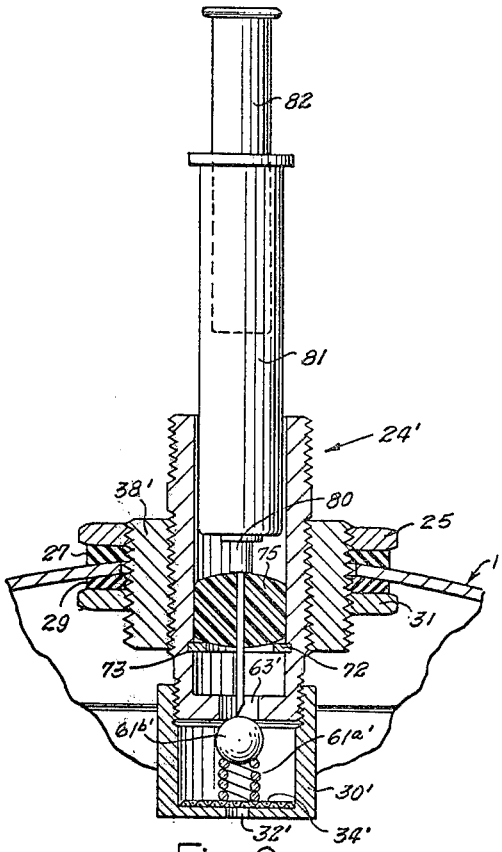
FIG. 6 is a cross-sectional view of the second embodiment showing the valve in a depressed, open condition.

A second embodiment of the injector 24', illustrated in FIGS. 5 and 6, comprises a tubular body 26' having a bore 28' extending longitudinally thereof. The lower wall of tubular body 26' has an aperture 63' communicating with the interior of cap 30'. Cap 30' is threadedly engaged with the lower portion of tubular body 26' and has an aperture 32' communicating with the interior of container 1. A spring urged check valve 61' comprising a ball **61*b*' and a spring 61*a*' is positioned to close aperture 63', and cap 30' holds strainer 34'**.

An annular snap ring washer 72 is located in annular groove 73 of tubular body 26 with a passage 74 located therein. Washer 72 acts only as a holding device for resilient substance 75 such as rubber or plastic, which is located in the bore 28' above washer 72.

Protective cap 42' is threadedly secured to the upper portion of tubular body 26' to prevent leakage when container 1 is pressurized. Adapter 38' is threadedly secured to tubular body 26'. Seal 27 is urged by nut 25 into sealing engagement with top 6 of the container 1 while seal 29 and nut 31 are tightened against the underside of wall 6 of the container 1 to hold the injector apparatus 24' in sealing engagement with the container.

To operate the injector apparatus 24' the protector cap 42' is disengaged and a syringe having a pointed needle 80, syringe chamber 81, and plunger 82 is inserted into the bore 28'. The needle 80 is then forced through the resilient substance 75 and passes through aperture 63' and strikes the spring urged valve ball **61*b*' thus opening the valve 61'. As plunger 82 is pressed downwardly, the pre-measured chemical liquid in syringe chamber 81 is forced through needle 80 into the interior of cap 30'. The liquid then flows by gravity through the aperture 32' into the container 1**.

As the needle 80 is withdrawn from the resilient substance 75, needle 80 is wiped clean thereby removing all traces of chemical and making the exterior of the syringe safe to handle. In addition, the passage through resilient substance 75 will close forming a seal which will not allow poison to flow back therethrough. The protective cap 42' is then replaced and a fully charged container 1 is ready for spraying after air is pumped into the container.

THIRD EMBODIMENT

Figure 7:
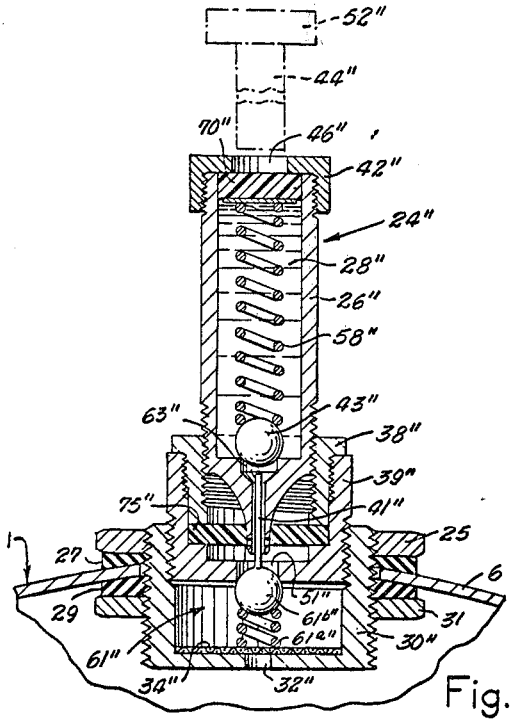
FIG. 7 is a cross-sectional view of a third embodiment.
Figure 8:
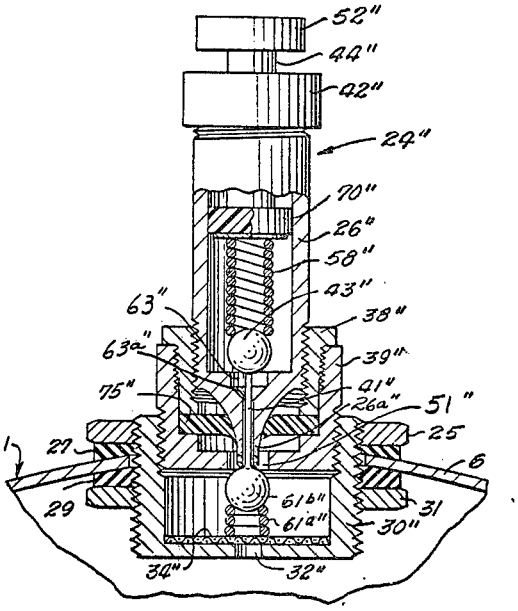
FIG. 8 is a cross-sectional view of a third embodiment, the discharge valve being illustrated in an open position.

FIGS. 7 and 8 illustrated a third embodiment of the injector apparatus 24'' comprising a tubular body 26'' having a bore 28'' extending longitudinally therethrough forming a chamber containing a premeasured quantity of liquid.

The upper end of the tubular body 26'' is threadedly engaged by a cap 42'' having a passage 46'' therethrough. Plunger 52'' is slidably disposed in passage 46'' and comprises a rod 44'' engageable with resilient sealing piston 70''. Resilient piston 70'' wipes the walls of bore 28'' to clean all traces of toxic chemicals therefrom.

Spring 58'' is disposed between resilient piston 70'' and valve ball 43'' to urge valve ball 43'' into sealing engagement with surfaces about opening 63'' to prevent the liquid from escaping from injector apparatus 24''. The lower end of tubular body 26'' extends to form a conical point on the end **26*a*'' having a passage 63*a*'' extending therethrough to allow rod 41''** to extend therethrough as will be more fully explained hereafter.

Tubular body 26'' is threadedly secured to an adapter 38'' which is detachably secured in coupling 39'' which is threadably engaged with cap 30''. Coupling 39'' has an aperture 51'' therethrough communicating with cap 30'' having an aperture 32'' therethrough communicating with container 1 and retains strainer 34'' to filter out debris.

Aperture 51'' is sealed by spring urged valve 61'' comprising a ball **61*b*'' and a spring 61*a*''. Ball 61*b*'' has a rod 41'' extending upwardly therefrom to extend through passage 63*a*'' and is arranged to engage ball 43'' to lift the ball 43'' from its seat when tubular body 26'' is fully engaged with adapter 38'' allowing the liquid contained in bore 28'' to flow through passage 63'', upon depression of plunger 52''**.

Conical point **26*a*'' is extended downward by screwing tubular body 26'' into adapter 38'' thereby pushing valve ball 61*b*'' from its seat to allow liquid to flow into cap 30''. It should be readily apparent that when tubular body 26'' is screwed completely into adapter 38'' that both valve ball 43'' and valve ball 61*b*''** are unseated and opened.

Coupling 39'' has a seal 75'' therein having a central opening **75*a* therein through which the lower end 26*a*'' of tubular body 26''** is arranged to extend.

Pressure is applied to plunger 52'' to force ball **61*b*'' off its seat against spring 61*a*'' allowing the liquid to pass into the cap 30'' and out through the aperture 32'' into the container 1**.

When plunger 52'' is released spring 58'' moves sealing piston 70'' back to the upward position. Spring **61*a*'' relaxes, moving valve ball 61*b*'' into sealing engagement with passage 51'' thus sealing the bore 28''. The cartridge 24'' may be removed for recharging by unthreading adapter 38'' from the lower end thereof and removing same. This allows spring 58'' to relax to move valve ball 43'' into sealing engagement with passage 63''**.

This unit can then be disassembled, sterilized and refilled by a competent technician. It should be noted that the rod 41'' extending through passage 63'' must push ball 43'' off its seat to eject the liquid from the tubular body 26''.

From the foregoing it should be readily apparent that each of the embodiments hereinbefore described accomplishes the objects of the invention hereinbefore discussed.

It should be appreciated that other and further embodiments of the invention may be devised without departing from the basic concept thereof.

Having described my invention, I claim:

1. Pesticide sprayer apparatus comprising: a sleeve having a bore extending therethrough forming a chamber containing a premeasured quantity of liquid pesticide; a conically-shaped lower end on said sleeve having a passage extending through said conically-shaped lower end; valve means in said passage, said valve means being moveable between a first position preventing flow of liquid from said chamber through said passage and a second position permitting flow of liquid through said passage; a container, said container having an upper end and a lower end; an air pump on said container, said air pump being adapted to deliver pressurized air into said container; a tube; means securing said tube to said container such that a lower end of said tube is positioned inside said container and adjacent the lower end of the container; a hose having one end secured to the upper end of said tube and another end secured to a spray gun; a valve body on said container, said valve body having a passage through which pesticide is introduced into said container, said passage through said valve body terminating inside said container adjacent the upper end of the container to assure mixing of pesticide introduced into said container with contents of the container before flowing into the lower end of said tube; means detachably securing said sleeve to said valve body, said passage formed in said conically-shaped lower end of said sleeve communicating with said chamber and terminating exteriorally of said sleeve and communicating with the passage in the valve body when said sleeve and said valve body are secured together; seal means on said valve body, said seal means being adapted to prevent leakage of liquid pesticide from said chamber to the outside of the container when said sleeve and said valve body are secured together; a rod in the passage in the valve body positioned to extend into the passage in the conically-shaped lower end of said sleeve to move said valve means from said first position to said second position when said sleeve is secured to said valve body and permitting movement of said valve means from said second position to said first position when said sleeve is not secured to said valve body and means to eject liquid from said chamber into said container.

2. Pesticide sprayer apparatus according to claim 1, said means to eject liquid from said chamber comprising: a piston in said chamber; and plunger means moveably secured in said sleeve to move said piston through said chamber.

3. In a system to mix and spray pesticide, the system comprising: a container, said container having a top and a bottom; an air pump on said container, said air pump being adapted to deliver pressurized air into said container; a tube; means securing said tube to said container such that a lower end of said tube is positioned inside said container and adjacent to the bottom of the container; a hose having one end secured to the upper end of said tube and another end secured to a spray gun; a valve body on said container, said valve body having a passage through which pesticide is introduced into said container, said passage through said valve body terminating inside said container adjacent the top of the container to assure mixing of pesticide introduced into the container with contents of the container before flowing into the lower end of said tube, said valve body having a first valve element secured thereto; a resilient seal element in the passage in the valve body, said resilient seal element having a central opening extending therethrough; means biasing said first valve element to a position closing said passage in said valve body; a pesticide container body having a passage formed therein; connector means to disengageably secure said pesticide container body to said valve body; and a hollow projection on said pesticide container body; said passage formed in the pesticide container body extending longitudinally of said hollow projection, said hollow projection being positionable through said central opening in said resilient seal element and engageable with said first valve element to move said first valve element to a position opening said passage in said valve body upon connection of said pesticide container body to said valve body such that the passage in the pesticide container body and the passage in the valve body are connected permitting flow of pesticide into said container.

4. The combination called for in claim 3 with the addition of: a second valve element in said pesticide container body, said second valve element being moveable between a first position closing the passage in the pesticide container body and a second position opening said passage in said pesticide container body; means biasing said second valve element to said first position; and a rod on said first valve element positionable through said passage in said projection to move said second valve element to said second position upon connection of said pesticide container body to said valve body.

5. A system to mix and spray pesticide according to claim 3, said pesticide container body comprising: a tubular body having a bore extending longitudinally therethrough; a piston in said bore; and means to move said piston through said bore to transfer pesticide from said pesticide container body into said container when the passage in the pesticide container body and the passage in the valve body are connected to permit flow of pesticide into said container.

* * * * *